US012501957B2

(12) United States Patent
Rutigliano

(10) Patent No.: US 12,501,957 B2
(45) Date of Patent: Dec. 23, 2025

(54) METHOD AND ASSEMBLY FOR CUSHIONING A PERSON'S HEAD FROM HEADPHONES

(71) Applicant: John Rutigliano, Atlanta, GA (US)

(72) Inventor: John Rutigliano, Atlanta, GA (US)

( * ) Notice: Subject to any disclaimer, the term of this patent is extended or adjusted under 35 U.S.C. 154(b) by 0 days.

(21) Appl. No.: 17/035,937

(22) Filed: Sep. 29, 2020

(65) Prior Publication Data

US 2022/0095730 A1 Mar. 31, 2022

(51) Int. Cl.
*A42B 1/02* (2006.01)

(52) U.S. Cl.
CPC ..... *A42B 1/02* (2013.01)

(58) Field of Classification Search
CPC ..... A42B 1/02; A42B 1/0182; A42B 1/019; A42B 1/08; A42B 1/04; A42B 1/041; A42B 1/062; A42B 1/12; A42B 1/004
USPC ..... 2/175.1, 195.1
See application file for complete search history.

(56) References Cited

U.S. PATENT DOCUMENTS 36,315 A * 8/1862 Warburton ..... A42B 1/06 2/172
344,231 A * 6/1886 Arnheim ..... A42B 1/0186 2/172
364,129 A * 5/1887 Plato ..... A42B 1/02 2/200.1
625,776 A * 5/1899 Von Klein ..... A42B 1/201 2/175.1
640,720 A * 1/1900 Thornton ..... A42B 1/04 2/204
787,390 A * 4/1905 Nash ..... A42B 1/02 2/175.5
822,986 A * 6/1906 Rochet ..... A42B 1/06 2/172
1,051,229 A * 1/1913 Hoeflich ..... A42B 1/04 2/204
1,103,876 A * 7/1914 Hermann ..... A42B 1/02 2/175.1
1,234,828 A * 7/1917 Tramana ..... A42B 1/02 2/175.4
1,380,703 A * 6/1921 Carlson ..... A42B 1/041 2/195.5
1,502,160 A * 7/1924 Reinthal ..... A42B 1/06 2/172
1,660,770 A * 2/1928 Solomon ..... A42B 1/04 2/200.1
1,687,346 A * 10/1928 Mondl ..... A42B 1/06 2/205

(Continued)

FOREIGN PATENT DOCUMENTS

WO WO2018075074 10/2016
WO WO2020036647 4/2018

*Primary Examiner* — Heather Mangine
*Assistant Examiner* — Raquel M. Weis

(57) ABSTRACT

A method and assembly for cushioning a person's head from headphones includes a crown that has an upper surface, a lower surface and a perimeter edge. The upper surface is convexly shaped and the lower surface is concavely shaped. A visor is attached to and extends along a front edge of the perimeter edge. The crown is comprised of a plurality of panels attached together including a central panel that traverses a central area of the crown from a first lateral edge to a second lateral edge. The central panel includes the apex and the central panel comprises a unitary member.

8 Claims, 6 Drawing Sheets

(56) References Cited

U.S. PATENT DOCUMENTS 1,747,918 A * 2/1930 Weingart ..... A42B 1/041 2/195.7
1,787,378 A * 12/1930 Hollenbeck ..... A42B 1/04 2/173.5
2,422,116 A * 6/1947 Mauro ..... A42B 1/08 2/414
2,735,109 A * 2/1956 Feldman ..... A42B 1/004 2/172
D178,682 S * 9/1956 Lipschutz ..... D2/882
2,896,218 A * 7/1959 Lipschutz ..... A42B 1/201 D2/882
3,039,113 A * 6/1962 Lipschutz ..... A42B 1/201 D2/882
3,133,289 A * 5/1964 Lipschutz ..... A42B 1/08 2/195.6
3,518,701 A * 7/1970 Fekete ..... A42B 1/06 2/172
4,222,125 A * 9/1980 Sewell-Wood ..... A42B 1/004 2/195.1
D257,184 S * 10/1980 Peham ..... D2/872
4,525,878 A * 7/1985 Lowe, Jr. ..... A42B 1/245 2/209.13
4,556,993 A * 12/1985 Okamura, Sr. ..... A42B 1/201 2/209.12
4,682,373 A * 7/1987 Baran ..... A42B 1/201 2/175.1
4,790,034 A * 12/1988 Pass ..... A42B 1/0181 2/255
5,099,524 A * 3/1992 Linday ..... A41D 20/00 2/171.1
5,239,704 A * 8/1993 Cornelio ..... A42B 1/0182 2/12
D352,379 S * 11/1994 Pierce, Jr. ..... D2/882
5,666,669 A * 9/1997 Sewell ..... A42B 1/0182 2/10
D396,136 S * 7/1998 Stein ..... D2/872
5,881,160 A * 3/1999 Sheppard ..... A42B 1/245 381/376
5,983,400 A 11/1999 Kronenberger
D417,770 S * 12/1999 Greenwood ..... D2/882
6,158,053 A * 12/2000 Wang ..... A42B 1/004 2/175.1
6,484,323 B1 * 11/2002 Pu ..... A42B 1/24 2/171.1
D480,539 S * 10/2003 Yan ..... D2/882
D580,634 S * 11/2008 Robinson ..... D2/869
8,627,515 B1 * 1/2014 Scott ..... A42B 1/201 2/175.1
8,640,264 B2 * 2/2014 Ramer ..... A42B 1/0182 2/195.1
8,804,987 B2 * 8/2014 Lee ..... A42B 1/245 381/301
9,332,797 B2 * 5/2016 Abers ..... A42B 1/245
2003/0041367 A1 * 3/2003 Hadden ..... A42B 1/0182 2/195.5
2004/0180691 A1 * 9/2004 Cascone ..... H01Q 1/245 455/556.1
2006/0117459 A1 * 6/2006 Miller ..... A42B 1/22 2/195.1
2007/0056078 A1 * 3/2007 Tseng ..... A42B 1/22 2/171
2009/0208040 A1 * 8/2009 Planansky ..... H04R 5/02 381/301
2009/0257615 A1 * 10/2009 Bayer, Jr. ..... A42B 1/0188 381/376
2010/0107317 A1 * 5/2010 Wang ..... A42B 1/08 2/411
2011/0061144 A1 * 3/2011 Chen ..... A42B 1/0182 2/195.1
2013/0064412 A1 * 3/2013 Alstad ..... H04R 1/1033 29/896.2
2014/0237706 A1 * 8/2014 O'Conner ..... A42B 1/08 2/410
2014/0338098 A1 * 11/2014 Kelly ..... A42B 1/18 2/195.1
2015/0373442 A1 12/2015 Saucedo
2017/0105461 A1 4/2017 Hancock
2017/0265551 A1 * 9/2017 Liljeblad ..... A42B 1/0188
2018/0055127 A1 * 3/2018 Plon ..... A42B 1/006
2018/0255860 A1 * 9/2018 Heaton ..... A42B 1/245
2019/0166941 A1 * 6/2019 Mao ..... A42B 1/0182
2019/0231014 A1 * 8/2019 Huynh ..... A42C 5/00
2019/0343208 A1 * 11/2019 Ching ..... A42C 5/04
2020/0121016 A1 * 4/2020 Skemp ..... A42B 1/08
2022/0095730 A1 * 3/2022 Rutigliano ..... A42B 1/0189

* cited by examiner

METHOD AND ASSEMBLY FOR CUSHIONING A PERSON'S HEAD FROM HEADPHONES

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to head protection device and more particularly pertains to a new head protection device for preventing injury or pain to a scalp while a person wears over-the-head headphones.

(2) Description of Related Art Including Information Disclosed Under 37 CFR 1.97 and 1.98

The prior art relates to head protection devices and in particular baseball caps which shield a person's head and eyes from the elements. However, conventional baseball caps typically include a plurality of panels intersecting at an apex of the cap and may also include buttons at the apex as well as other attachments such as washers forming small openings in the caps. All of these features and the seams between panels create areas on the cap which are more rigid than the fabric or materials being used for the remainder of the panels. These rigid areas form pressure points which can agitate a user's head when they interact with a headphone headband or the ear coverings of the headphones. Therefore a more comfortable baseball cap is desired which is comfortable to wear with over-the-head headphones.

BRIEF SUMMARY OF THE INVENTION

An embodiment of the disclosure meets the needs presented above by generally comprising a crown that has an upper surface, a lower surface and a perimeter edge. The upper surface is convexly shaped and the lower surface is concavely shaped. The perimeter edge includes a front edge, a rear edge, a first lateral edge and a second lateral edge. The crown has an apex. A visor is attached to and extends along the front edge of the perimeter edge. The crown is comprised of a plurality of panels attached together including a central panel traversing a central area of the crown from the first lateral edge to the second lateral edge. The central panel forms at least a portion of each of the first and second lateral edges. The central panel includes the apex and the central panel comprises a unitary member. The upper and lower surfaces of the central panel are smooth and the apex is free of attachments and protrusions. The plurality of panels includes a front panel is attached to each of and extending between the visor and the central panel. The plurality of panels includes a rear panel attached to the central panel and extending to the rear edge.

In another embodiment, a method includes positioning a baseball cap assembly on a person's head wherein the baseball cap includes a crown has an upper surface, a lower surface and a perimeter edge. The upper surface is convexly shaped and the lower surface is concavely shaped. The perimeter edge includes a front edge, a rear edge, a first lateral edge and a second lateral edge. The crown has an apex and a visor is attached to and extends along the front edge of the perimeter edge. The crown is comprised of a plurality of panels attached together. The plurality of panels includes a central panel traversing a central area of the crown from the first lateral edge to the second lateral edge. The central panel forms at least a portion of each of the first and second lateral edges. The central panel includes the apex and comprises a unitary member. The upper and lower surfaces of the central panel are smooth and the apex is free of attachments and protrusions. The plurality of panels includes a front panel attached to each of and extending between the visor and the central panel. A front seam is defined joining the front panel to the central panel. The plurality of panels includes a rear panel attached to the central panel and extending to the rear edge. A rear seam is defined joining the rear panel to the central panel. The crown is seamless between the front and rear seams. A pair of headphones is positioned on the upper surface of the crown such that a headband of the headphones abuts and extends along the central panel and the apex.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
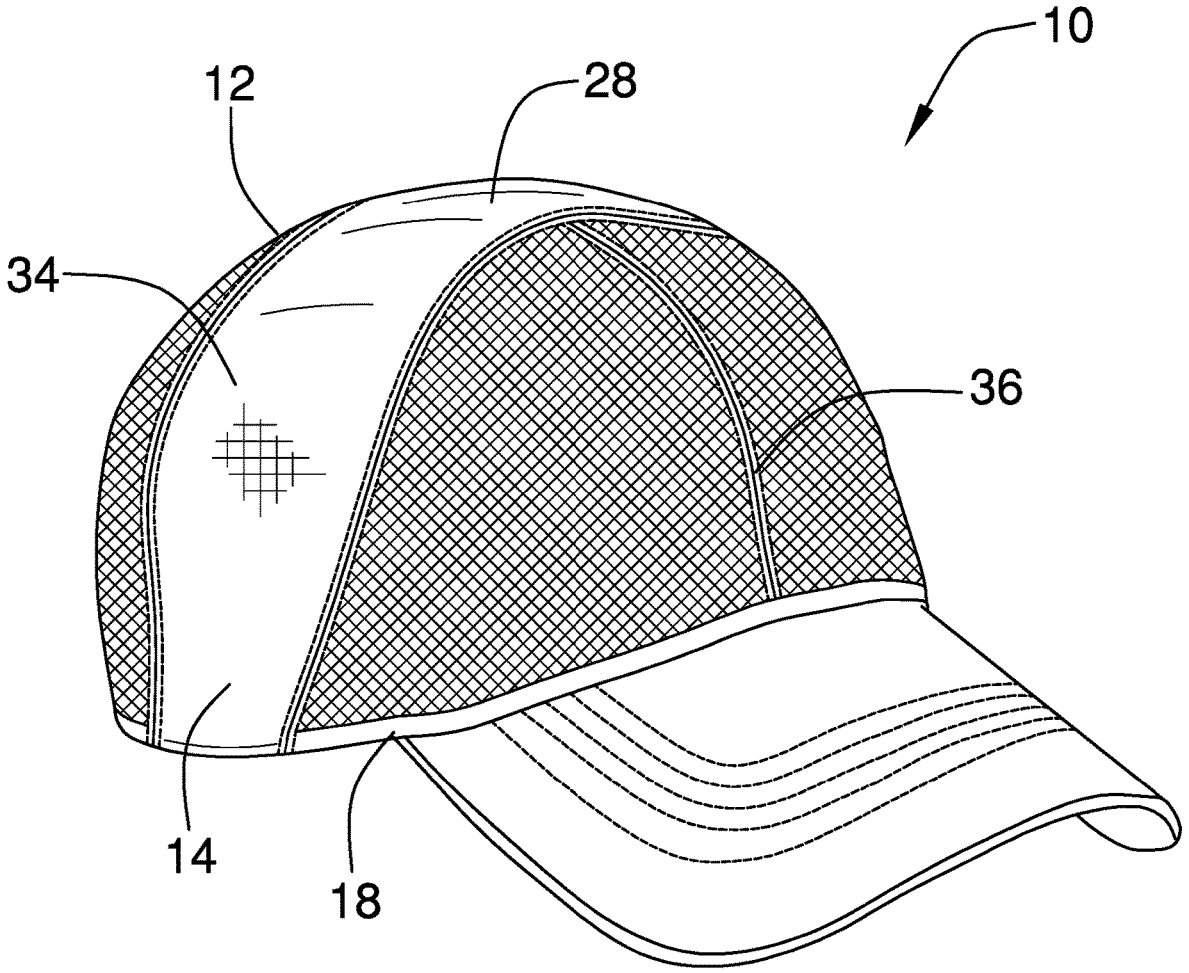
FIG. 1 is a front isometric view of a method and assembly for cushioning a person's head from headphones according to an embodiment of the disclosure.
Figure 2:
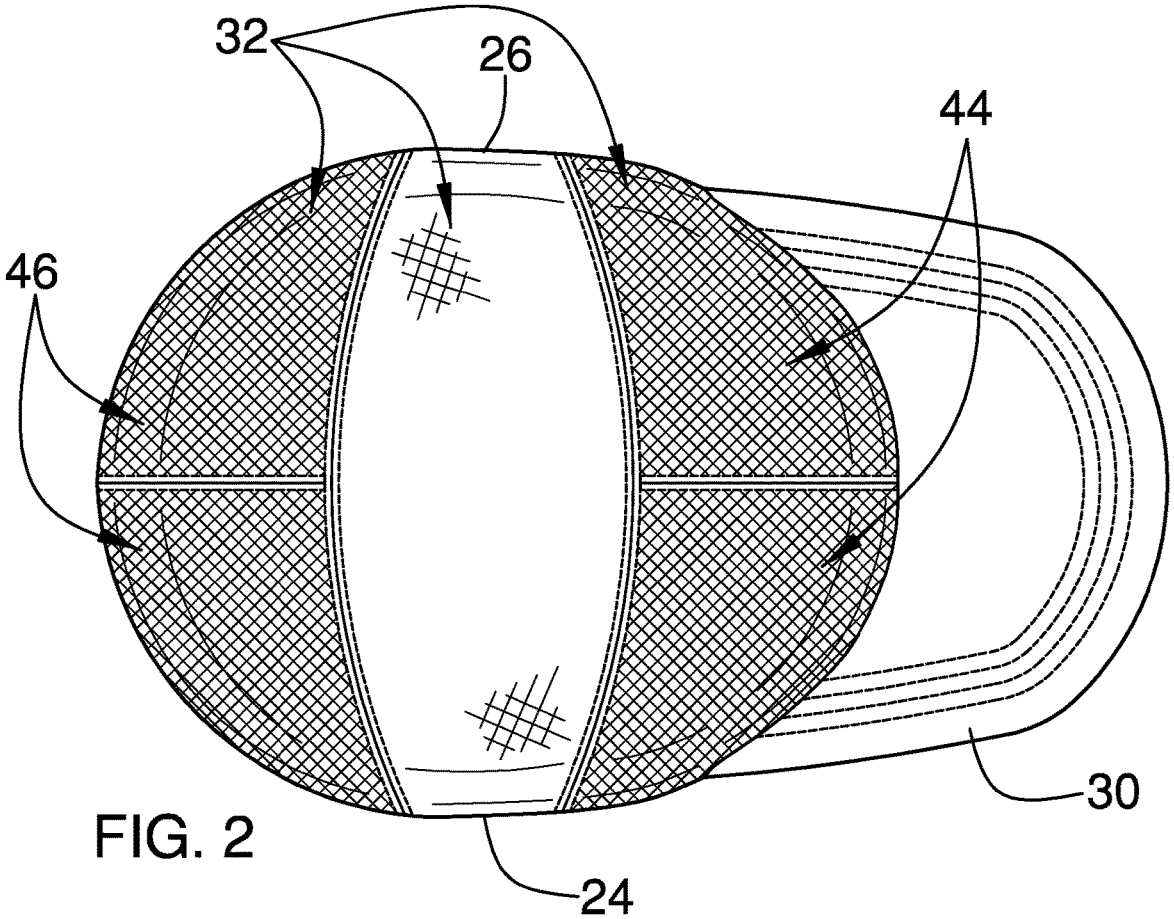
FIG. 2 is a top view of an embodiment of the disclosure.
Figure 3:
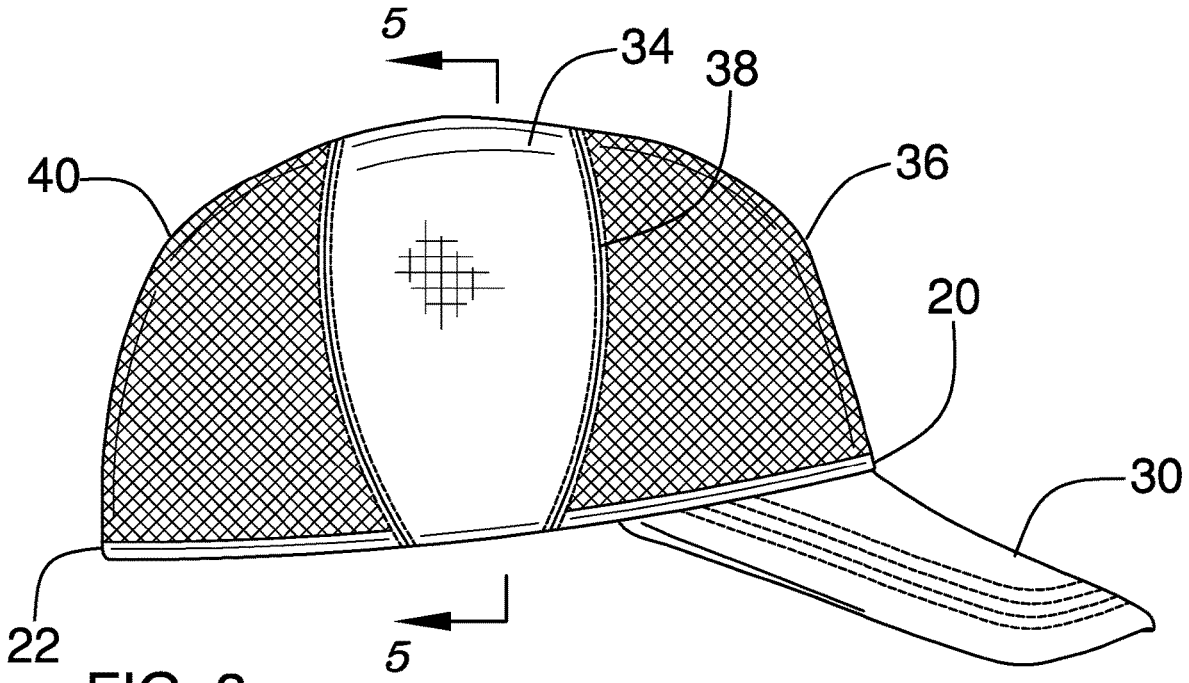
FIG. 3 is a side view of an embodiment of the disclosure.
Figure 4:
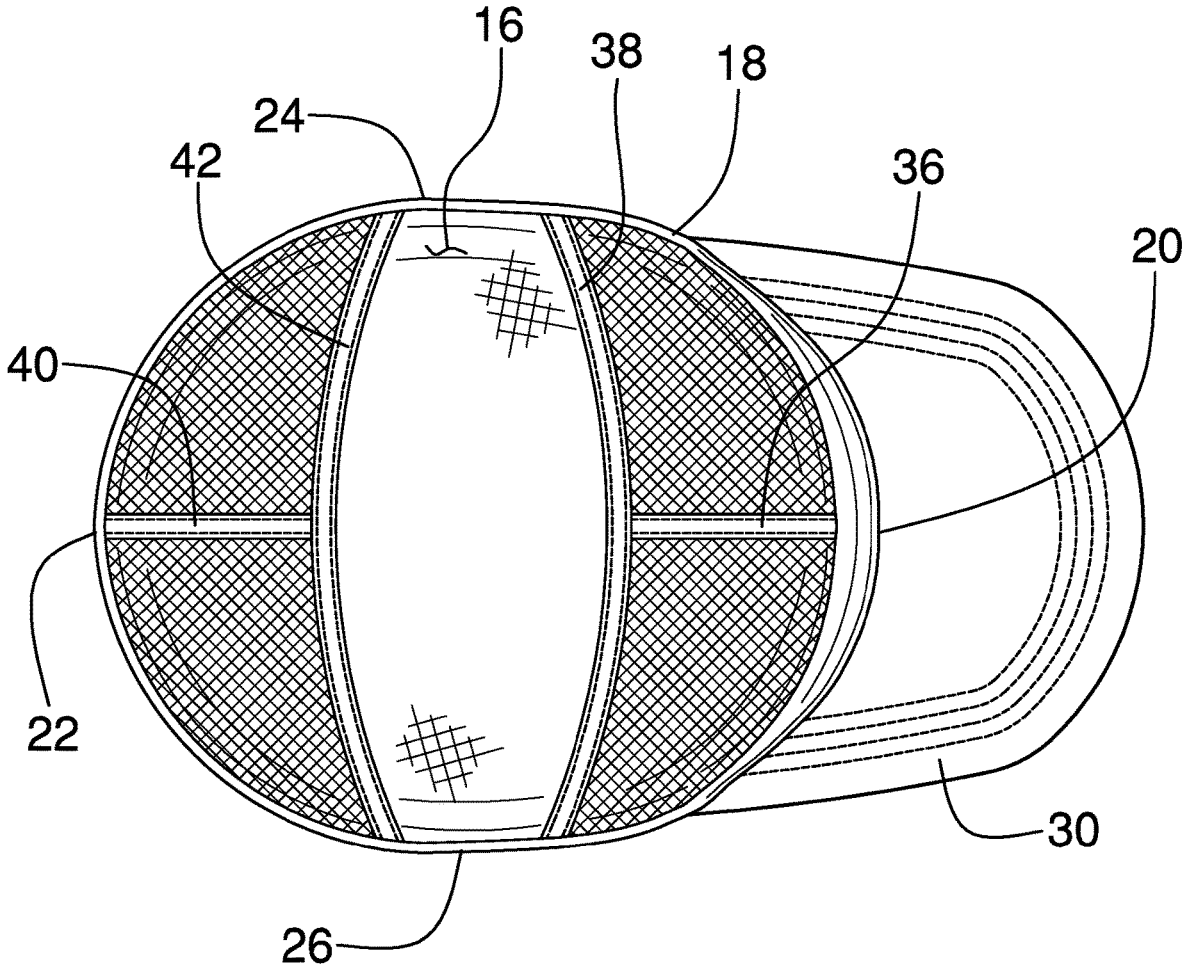
FIG. 4 is a bottom view of an embodiment of the disclosure.
Figure 5:
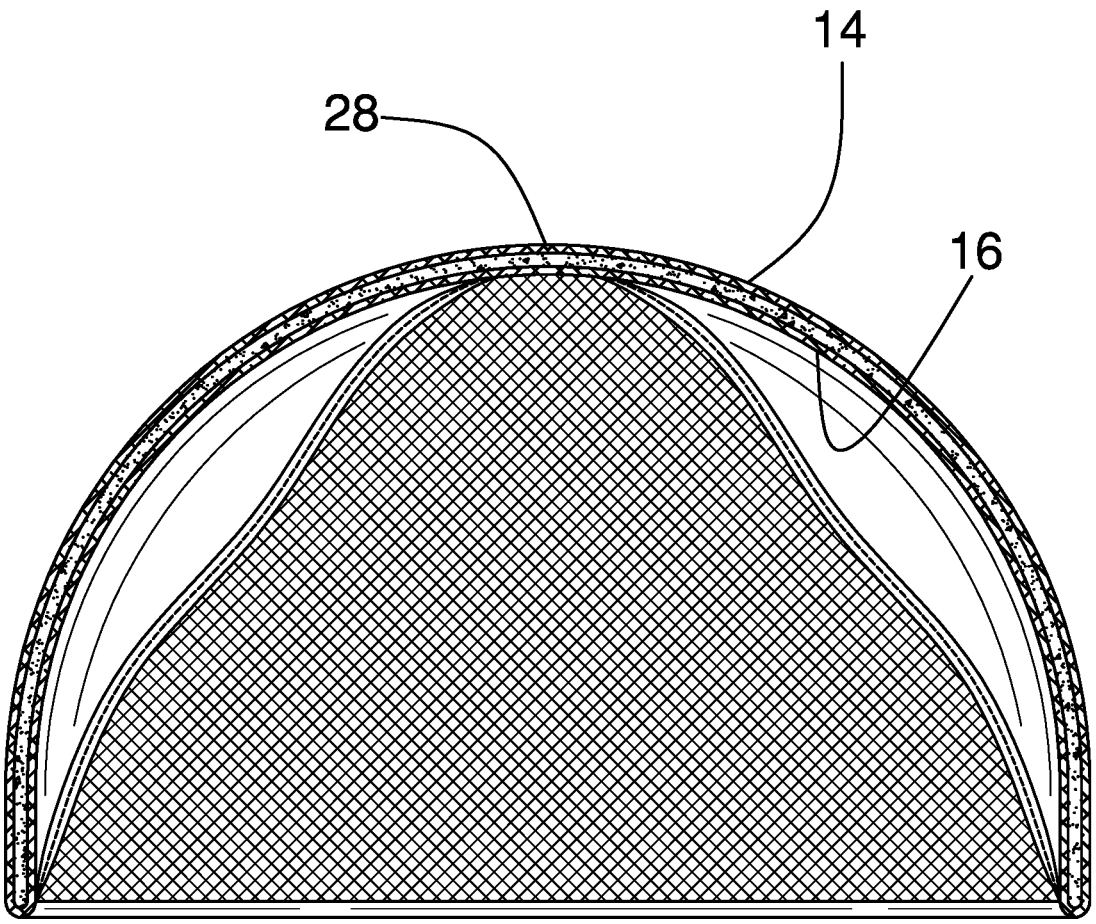
FIG. 5 is a cross-sectional view of an embodiment of the disclosure taken along line 5-5 of FIG. 3.
Figure 6:
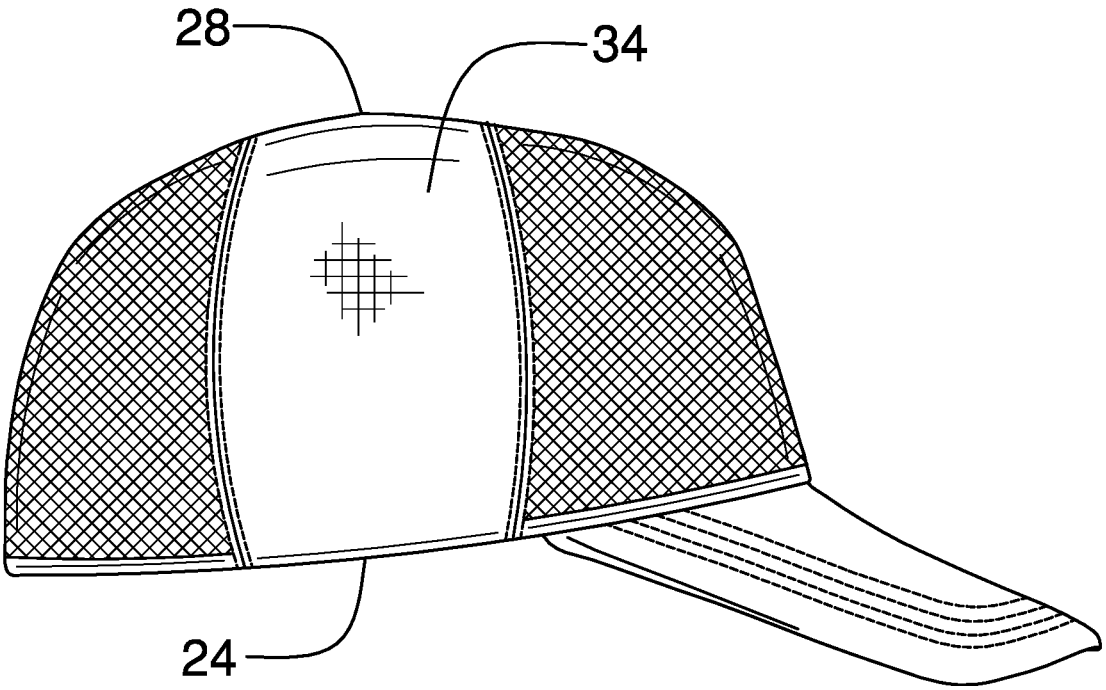
FIG. 6 is a side view of an embodiment of the disclosure.
Figure 7:
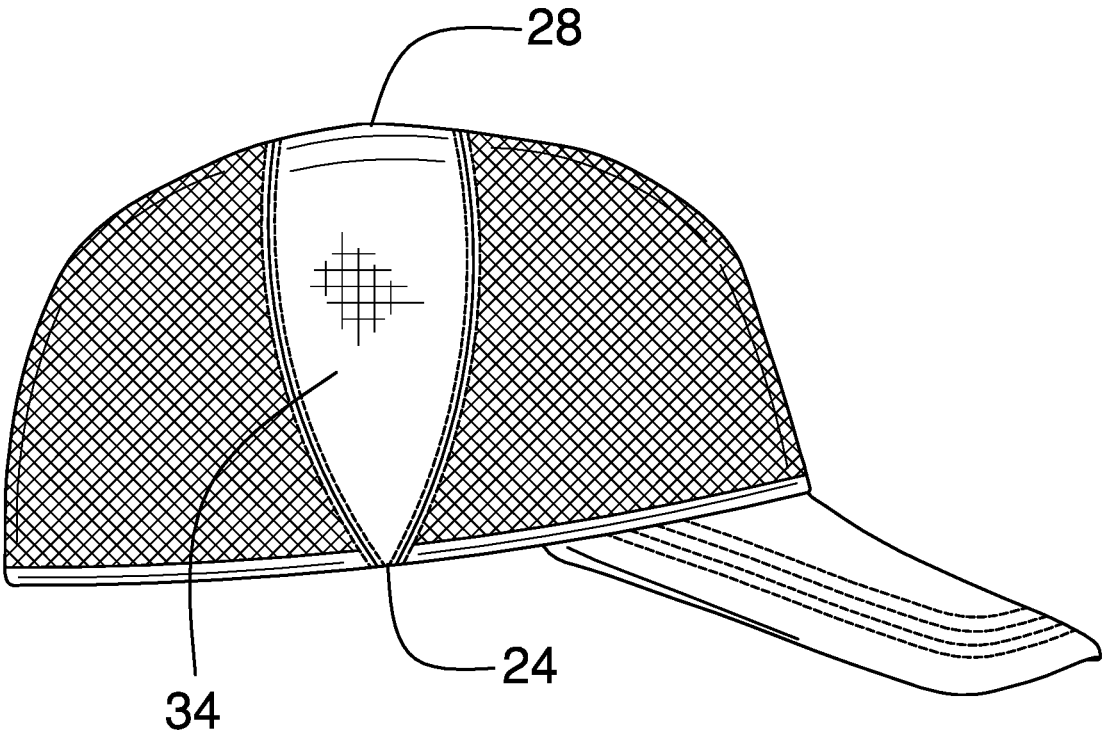
FIG. 7 is a side view of an embodiment of the disclosure.
Figure 8:
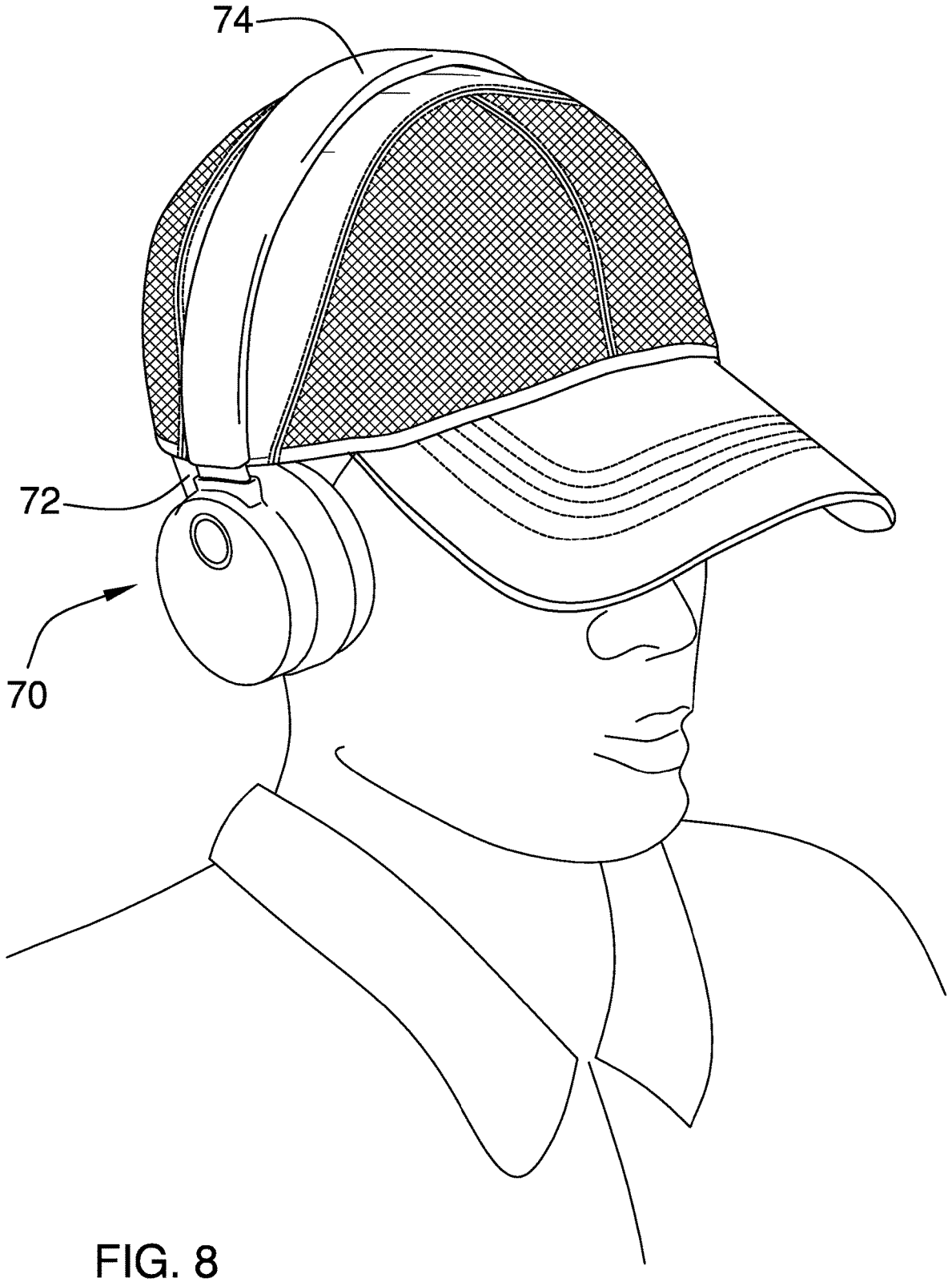
FIG. 8 is an in-use front isometric view of an embodiment of the disclosure.

With reference now to the drawings, and in particular to FIGS. 1 through 8 thereof, a new head protection device embodying the principles and concepts of an embodiment of the disclosure and generally designated by the reference numeral 10 will be described.

As best illustrated in FIGS. 1 through 8 the method and assembly 10 for cushioning a person's head 72 from headphones 70 generally comprises a crown 12 that has an upper surface 14, a lower surface 16 and a perimeter edge 18. The upper surface 14 is convexly shaped and the lower surface 16 is concavely shaped. The perimeter edge 18 includes a front edge 20, a rear edge 22, a first lateral edge 24 and a second lateral edge 26. The crown 12 has an apex 28. A visor 30 is attached to and extends along the front edge 20 of the perimeter edge 18. The crown 12 and visor 30 define a conventional looking and functioning baseball cap.

The crown 12 is comprised of a plurality of panels 32 attached together. The plurality of panels 32 includes a central panel 34 traversing a central area of the crown 12 from the first lateral edge 24 to the second lateral edge 26. The central panel 34 forms at least a portion of each of the first 24 and second 26 lateral edges. Thus, the central panel 34 may be provided in different shapes, such as shown in the differences in FIGS. 3, 6 and 7; however the central panel 34 in each instance extends to and includes portions of the first 24 and second 26 lateral edges.

The central panel 34 includes the apex 28 and will be comprised of a unitary member. The upper 14 and lower 16 surfaces of the central panel 34 are smooth and the apex 28 is free of attachments and protrusions. That is, the central panel 34 will be a single, uniform piece of material, typically without openings, which will be free of seams from stitching or other mechanical connections including adhesives, heat bonding, friction bonding and the like. Furthermore, buttons, as are often found on a baseball hat crown, will not be placed on the central panel 34 particularly at the apex 28. Thus, when pressure is placed on the central panel 34 at any point along its surface, there will be no areas which do not uniformly compress and thereby prevent any localized pressure points. Since baseball caps typically include a plurality of panels intersecting at the apex as well as a button, there are pressure points at or adjacent to the apex and along seams. When an object, such as a headband 74 for headphones 70, is placed against these seems and button, the weight of object is concentrated onto those areas. As these areas are less compressible than the remaining portions of a baseball hat, and the weight of the object is concentrated on those areas, soreness will develop on the person's scalp where the weight is focused at those areas. The central panel 34, however, avoids this problem by lacking in any seams or other attachments.

The central panel 34 may be comprised of any conventional material used for a baseball cap or hats in general. Therefore canvas, mesh, and other similar materials may be utilized. In some embodiments the central panel 34 may comprise a resiliently compressible material. The resiliently compressible material may consist of a single material from the upper surface 14 to the lower surface 16, or it may include layers as shown FIG. 5 wherein a foam layer, for instance, is encased in fabric outer layers. Alternate embodiments may include a gel interior or materials that emphasize air permeability.

The plurality of panels 32 includes a front panel 36 that is attached to each of and extends between the visor 30 and the central panel 34. A front seam 38 is defined joining the front panel 36 to the central panel 34. The plurality of panels 32 also includes rear panel 40 that is attached to the central panel 34 and extends to the rear edge 22. A rear seam 42 is defined joining the rear panel 40 to the central panel 34. In agreement with the statements above regarding the structure of the central panel 34, the crown 12 is seamless between the front 38 and rear 42 seams as that area is occupied by the central panel 34. As can be seen in the Figures, the front panel 32 may include a plurality of front panel sections 44 and the rear panel 40 may also include a plurality of rear panel sections 46. The front 36 and rear 40 panels may be made of any conventional material utilized in baseball hats, though certain materials which promote air permeability such as breathable fabrics or mesh materials may be preferred to prevent heat build-up during the usage of the assembly.

In use, the assembly 10 is worn as a conventional baseball hat. However, when the wearer of the assembly 10 also utilizes headphones 70 with a headband 74, the headband 74 is positioned on the central panel 34 since the first 24 and second 26 lateral edges are aligned with the ears of the wearer. The central panel 34, being free of any irregularities in terms of tactile response, performs as a cushion between the wearer's head 72 and the headband 74. Because the central panel 34 is uniform throughout its length from the first lateral edge 24 to the second lateral edge 26, the headband 74 will not press on any hard or stiffer areas which would lead to soreness of the head 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A baseball cap assembly comprising:

a crown having an upper surface, a lower surface and a perimeter edge, the upper surface being convexly shaped and the lower surface being concavely shaped, the perimeter edge including a front edge, a rear edge, a first lateral edge and a second lateral edge, the crown having an apex;

a visor being attached to and extending along the front edge of the perimeter edge, the visor having opposite lateral edges coupled to the front edge of the perimeter edge, the perimeter edge of the crown being a free edge extending away from and between each of the opposite lateral edges of the visor;

the crown being comprised of a plurality of panels attached together, the plurality of panels including a central panel comprising four central panel edges, the four central panel edges including a front edge, an opposite back edge to the front edge, a right lateral edge, and an opposite left lateral edge to the right lateral edge, wherein the central panel traverses a central area of the crown continuously from the first lateral edge to the second lateral edge, the right lateral edge end being directly contiguous with the first lateral edge and the left lateral edge being contiguous with the second lateral edge, the central panel forming at least a portion of each of the first and second lateral edges within the free edge of the crown, the central panel including the apex, the central panel comprising a unitary member, the upper and lower surfaces of the central panel being smooth and the apex being free of attachments and protrusions;

said central panel comprising a foam layer being encased in fabric outer layers;

the plurality of panels including a front panel being attached to and extending between the visor and the central panel, the front panel comprising a front left and a front right panel, the front left and front right panels conjoined to make the front panel;

the plurality of panels further including a rear panel being attached to the central panel and extending to the rear edge, the rear panel comprising a rear left and a rear right panel, the rear left and rear right panels conjoined to make the rear panel.

2. The baseball cap assembly according to claim 1, further including a front seam being defined joining the front panel to the central panel, a rear seam being defined joining the rear panel to the central panel, the crown being seamless between the front and rear seams.

3. The baseball cap assembly according to claim 2, wherein the central panel comprises a resiliently compressible material.

4. The baseball cap assembly according to claim 2, wherein the central panel comprising an air permeable material.

5. The baseball cap assembly according to claim 1, wherein the front panel includes a plurality of front panel sections and the rear panel includes a plurality of rear panel sections.

6. The baseball cap assembly according to claim 1, wherein the central panel comprises a resiliently compressible material.

7. The baseball cap assembly according to claim 1, wherein the central panel comprising an air permeable material.

8. A baseball cap assembly comprising:

a crown having an upper surface, a lower surface and a perimeter edge, the upper surface being convexly shaped and the lower surface being concavely shaped, the perimeter edge including a front edge, a rear edge, a first lateral edge and a second lateral edge, the crown having an apex;

a visor being attached to and extending along the front edge of the perimeter edge, the visor having opposite lateral edges coupled to the front edge of the perimeter edge, the perimeter edge of the crown being a free edge extending away from and between each of the opposite lateral edges of the visor;

the crown being comprised of a plurality of panels attached together, the plurality of panels including a central panel comprising four central panel edges, the four central panel edges including a front edge, an opposite back edge to the front edge, a right lateral edge, and an opposite left lateral edge to the right lateral edge, wherein the central panel traverses a central area of the crown continuously from the first lateral edge to the second lateral edge, the right lateral edge end being directly contiguous with the first lateral edge and the left lateral edge being contiguous with the second lateral edge, the central panel forming at least a portion of each of the first and second lateral edges within the free edge of the crown, the central panel including the apex, the central panel comprising a unitary member, the upper and lower surfaces of the central panel being smooth and the apex being free of attachments and protrusions;

said central panel comprising a foam layer being encased in fabric outer layers;

the plurality of panels including a front panel being attached to and extending between the visor and the central panel, the front panel comprising a front left and a front right panel, the front left and front right panels conjoined to make the front panel, a front seam being defined joining the front panel to the central panel;

the plurality of panels including a rear panel being attached to the central panel and extending to the rear edge, the rear panel comprising a rear left and a rear right panel, the rear left and rear right panels conjoined to make the rear panel, a rear seam being defined joining the rear panel to the central panel;

the crown being seamless between the front and rear seams;

the front panel including a plurality of front panel sections;

the rear panel including a plurality of rear panel sections;

the central panel comprising a resiliently compressible material; and the central panel comprising an air permeable material.

* * * * *